US010279492B2

(12) United States Patent
Phoon et al.

(10) Patent No.: US 10,279,492 B2
(45) Date of Patent: May 7, 2019

(54) COUPLING MECHANISM FOR A DRIVE TRAIN OF A HAIR CUTTING APPLIANCE

(71) Applicant: KONINKLIJKE PHILIPS N.V., Eindhoven (NL)

(72) Inventors: Kin Fatt Phoon, Eindhoven (NL); Marcus Franciscus Eijkelkamp, Eindhoven (NL); Geert Willem De Goeij, Eindhoven (NL); Albert Jan Aitink, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 45 days.

(21) Appl. No.: 15/301,728

(22) PCT Filed: Apr. 14, 2015

(86) PCT No.: PCT/EP2015/058009
§ 371 (c)(1),
(2) Date: Oct. 4, 2016

(87) PCT Pub. No.: WO2015/158681
PCT Pub. Date: Oct. 22, 2015

(65) Prior Publication Data

US 2017/0120466 A1 May 4, 2017

(30) Foreign Application Priority Data

Apr. 18, 2014 (EP) ..... 14165280

(51) Int. Cl.
*B26B 19/28* (2006.01)
*B26B 19/38* (2006.01)
*B26B 19/06* (2006.01)

(52) U.S. Cl.
CPC ..... *B26B 19/28* (2013.01); *B26B 19/386* (2013.01); *B26B 19/063* (2013.01)

(58) Field of Classification Search
CPC ..... B26B 19/02; B26B 19/046; B26B 19/28; B26B 19/06; B26B 19/14; B26B 19/145; B26B 19/386; B26B 19/063
(Continued)

(56) References Cited

U.S. PATENT DOCUMENTS 4,631,825 A * 12/1986 Kuriyama ..... B26B 19/04 30/34.1
4,979,297 A 12/1990 Bertram
(Continued)

FOREIGN PATENT DOCUMENTS

CA 2386694 A1 * 11/2002 ..... B26B 19/141
CA 2465591 A1 * 11/2004 ..... B26B 19/14
(Continued)

*Primary Examiner* — Jennifer B Swinney

(57) ABSTRACT

The present invention relates to a drive train (50) of a hair cutting appliance (10) and to a self-aligning coupling linkage (66) for a drive train (50). The coupling linkage (66) comprises a driving shaft and a non-aligning output shaft (56), said coupling linkage (66) comprising: a first driving coupling element (78) arranged to be driven by a driving shaft (54), particularly by a motor shaft, a transmission shaft (70), particularly a rigid transmission shaft (70), comprising a first drivable coupling element (80) at a first end and a second driving coupling element (86) at a second end thereof, wherein first driving coupling element (78) engages the first drivable coupling element (80) for rotatingly driving the transmission shaft (70), thereby forming a first pivoting joint (76), wherein the second driving coupling element (86) is arranged to engage a second drivable coupling element (88) of an output shaft (56), wherein the first driving coupling element (78) and the first drivable coupling element (80) define a male connector comprising an external polygonal profile (90), viewed in a cross-sectional plane perpendicular to a longitudinal axis, and a female connector comprising an internal polygonal profile (102), and wherein
(Continued)

the external polygonal profile (90) of the male connector, viewed in a longitudinal axial section, is at least sectionally provided with convexly shaped flanks (92).

12 Claims, 4 Drawing Sheets

(58) Field of Classification Search
USPC ..... 30/43.4, 43.5, 43.91, 43.92
See application file for complete search history.

(56) References Cited

U.S. PATENT DOCUMENTS

| | | | | |
|---|---|---|---|---|
| 7,530,171 | B2 * | 5/2009 | Baron | B26B 19/14 30/205 |
| 2003/0019107 | A1 | 1/2003 | Visman | |
| 2005/0055834 | A1 | 3/2005 | Cheah | |
| 2014/0130642 | A1 | 5/2014 | Rodriquez | |
| 2017/0120466 | A1 | 4/2017 | Phoon | |

FOREIGN PATENT DOCUMENTS

| | | | | |
|---|---|---|---|---|
| CN | 201443579 | U | | 4/2010 |
| EP | 1417079 | B1 | | 5/2004 |
| GB | 2113596 | A | | 8/1983 |
| JP | 06182065 | A | * | 7/1994 |
| JP | 09068235 | A | | 3/1997 |
| JP | 4818910 | A | | 11/2011 |
| WO | 9529042 | A1 | | 11/1995 |
| WO | 2004065078 | A1 | | 8/2004 |
| WO | 2009143117 | A1 | | 11/2009 |
| WO | 2010101983 | A1 | | 9/2010 |
| WO | 2013150412 | A1 | | 10/2013 |

* cited by examiner

COUPLING MECHANISM FOR A DRIVE TRAIN OF A HAIR CUTTING APPLIANCE

This application is the U.S. National Phase application under 35 U.S.C. § 371 of International Application No. PCT/EP2015/058009, filed on Apr. 14, 2015, which claims the benefit of International Application No. 14165280.0 filed on Apr. 18, 2014. These applications are hereby incorporated by reference herein.

FIELD OF THE INVENTION

The present disclosure relates to a hair cutting appliance, particularly to an electrically operated hair cutting appliance, and more particularly to a coupling linkage mechanism for a drive train of a hair cutting appliance.

BACKGROUND OF THE INVENTION

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that prevents hair from being cut off close to the skin. Consequently, a user desiring to both shave and trim his/her body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembly processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles some of these issues by providing for a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows longer hairs to enter the slots and, consequently, to be cut by the relative cutting motion between the movable blade and the stationary blade.

However, there is still a need for improvement in hair cutting appliances. This may particularly involve user comfort related aspects and performance related aspects. Particularly with hair cutting appliances comprising blade sets that are pivotably attached to the housing, the drive train and particularly the power transmission arrangement between a motor and the blade set needs to be adapted to the pivotable arrangement. Furthermore, since the housing portion may be adequately shaped so as to permit an appropriate ergonomic positioning and orientation of the appliance with respect to the skin of the user, the blade set may be arranged at an angle with respect to the housing. This may pose further challenges.

SUMMARY OF THE INVENTION

It is an object of the present disclosure to provide a drive train, particularly a coupling linkage for a drive train of a hair cutting appliance that may enhance the operating performance of the appliance and contributes to a pleasant user experience. Furthermore, it is desired to provide a hair cutting appliance fitted with a respective drive train. It is particularly desired that the hair cutting appliance enables both shaving and trimming operations. Even more particularly, it is desired that the cutting appliance exhibits an advanced contour following capability. Preferably, the present disclosure may generally address at least some drawbacks inherent in known prior art hair cutting appliances as discussed above, for instance. It may be further desirable to provide a drive train that is particularly suited for angular offset compensation. It would be further preferred to diminish unpleasant emissions that may emerge from a drive train, e.g. running noises and vibrations.

In a first aspect of the present invention a coupling linkage for a drive train of a hair cutting appliance comprising a driving shaft and a non-aligning output shaft is presented, said coupling linkage comprising:

- a first driving coupling element arranged to be driven by a driving shaft, particularly by a motor shaft,
- a transmission shaft, particularly a rigid transmission shaft, comprising a first driveable coupling element at a first end and a second driving coupling element at a second end thereof, wherein the first driving coupling element engages the first driveable coupling element for rotatingly driving the transmission shaft, thereby forming a first pivoting joint, wherein the second driving coupling element is arranged to engage a second driveable coupling element of an output shaft, wherein the first driving coupling element and the first driveable coupling element define a male connector comprising an external polygonal profile, viewed in a cross-sectional plane perpendicular to a longitudinal axis, and a female connector comprising an internal polygonal profile, and wherein the external polygonal profile of the male connector, viewed in a longitudinal axial section, is at least sectionally provided with convexly shaped flanks.

This aspect is based on the insight that the coupling linkage may provide the drive train with the ability to span angular and/or parallel offsets between the driving shaft and the output shaft. More particularly, a hair cutting appliance fitted with the coupling linkage may be configured to make use of a housing that comprises a neck portion that is inclined with respect to a base portion or gripping portion thereof. This may significantly improve the visibleness of the appliance during operation, particularly when shaving. Consequently, handling the device may be improved. Furthermore, the coupling linkage may be provided with the ability to compensate angular deviations. Angular deviations may involve constant deviations but also variable deviations. This may be beneficial since in this way the drive train may become considerably tolerant to angular deviations between the driving shaft and the output shaft. This may reduce the need of providing high precision parts for the drive train and the housing of the hair cutting appliance. Consequently, manufacturing the drive train and the hair cutting appliance may be simplified.

The coupling linkage may generally be referred to as coupling linkage mechanism, preferably as self-aligning coupling linkage mechanism. The coupling linkage may be arranged to replace a conventional universal joint. At least in some embodiments, the coupling linkage may be utilized to compensate parallel offset deviations between the driving shaft and the output shaft.

In one embodiment, the first driveable coupling element at the first end of the transmission shaft is arranged as an axially extending recess comprising an internal polygonal profile, and wherein the first driving coupling element is arranged as a substantially axially extending external polygonal profile. Consequently, the driving coupling element and the driveable coupling element may be engaged basically without significant (circumferential) backlash or backlash-free.

In one embodiment, the second driving coupling element and the second driveable coupling element form a second pivoting joint when brought into engagement, wherein the second driving coupling element at the second end of the transmission shaft is arranged as a male connector comprising an external polygonal profile, wherein the second driveable coupling element of the output shaft is arranged as a female connector comprising an axially extending recess comprising an internal polygonal profile.

In one embodiment, the coupling linkage further comprises a biasing element, particularly a spring element, wherein the biasing element is interposed between the first driveable coupling element and the first driving coupling element. The biasing element may be configured to compensate length deviations in the drive train. Since the involved components may be at least slightly preloaded, particularly axially preloaded, running noises may be further reduced.

In one embodiment, the biasing element is arranged in an axially extending recess at the transmission shaft, wherein the biasing element urges the first driveable coupling element and the first driving coupling element substantially in an axial longitudinal direction of the transmission shaft. Consequently, the biasing element is covered and protected by the transmission shaft.

In one embodiment, the biasing element is coupled to a push rod slidably arranged at the transmission shaft, wherein the push rod is arranged to contact the first driving coupling element.

In one embodiment, the external polygonal profile of each male connector is at least sectionally provided with spherical flanks. Consequently, the respective shafts may swivel with respect to each other, thereby altering their relative angular orientation. The spherical flanks may comprise spheric or globular surfaces that may ensure that the respective driving coupling elements and driveable coupling elements are in close contact for transmitting rotation. This may further reduce running noises. The spherical flanks may roll with respect to their counterparts upon relative angular motion between neighboring shafts.

In one embodiment, the internal polygonal profile of each female connector comprises a number of circularly arranged protrusions alternating with indentations disposed therebetween, wherein the protrusions and the indentations define contact flanks arranged to contact the flanks of the polygonal profile of the respective male connector. The contact flanks may comprise a basically planar shape. Consequently, manufacturing the internal polygonal profile may be simplified.

In one embodiment, the number of contact flanks of the female connector is adapted to the number of flanks of the male connector. In one embodiment, the female connector and the male connector of at least one of the first pivoting joint and the second pivoting joint are configured in such a way that the pivoting joint exhibits a defined circumferential backlash. This may simplify inserting the external polygonal profile into the internal polygonal profile. However, it may be preferred that a minimized circumferential backlash is provided at the pivoting joint.

In a further aspect of the present invention a drive train for a cutting head of a hair cutting appliance is presented, the drive train comprising a driving shaft, an output shaft and a coupling linkage in accordance with at least some embodiments of the present disclosure, wherein the driving shaft and the output shaft are arranged at an angular offset, wherein the coupling linkage connects the driving shaft and the output shaft, and wherein the output shaft comprises an eccentric portion arranged to engage a transmitting member of a blade set for driving a movable cutter blade thereof in a reciprocating manner.

In a further aspect of the present invention a hair cutting appliance is presented, particularly an electrically operable hair cutting appliance, said hair cutting appliance comprising a housing, a cutting head attached to said housing, and a drive train comprising a driving shaft, an output shaft and a coupling linkage in accordance with at least some embodiments of the present disclosure, wherein the cutting head comprises a blade set comprising a movable cutter blade and a stationary blade, wherein the movable cutter blade is movable with respect to the stationary blade, and wherein the drive train is arranged to actuate the movable cutter blade when the cutting head is attached to the housing.

It is further preferred that the hair cutting appliance is selectively operable in a shaving mode and a trimming mode. It is further preferred in this context that the cutting head is operable in a contour following mode, particularly when shaving. The contour following mode may involve a pivotable mounting of the blade set such that the blade set may be adapted to an actual skin surface. Furthermore, it may be preferred that the cutting head is operable in a trimming mode. The trimming mode may involve a fixed angular swivel orientation of the blade set with respect to the housing.

Preferably, the cutting head is releasably attached to said housing. Consequently, the drive train may comprise an interface where respective components may be disengaged and separated when the cutting head is released.

In one embodiment of the hair cutting appliance, the movable cutter blade is arranged in a guide slot and laterally movable with respect to the stationary blade, wherein the second pivoting joint defines an releasable coupling interface, wherein the output shaft and the second driveable coupling element are detachable from the second driving coupling element and the transmission shaft when the cutting head is released from the housing, thereby releasing the second driveable coupling element from engagement with the second driving coupling element.

In one embodiment, the hair cutting appliance may further comprise a main portion formed by the housing, and a neck portion, wherein the main portion houses a motor, wherein the blade set is attached to the neck portion, and wherein the neck portion is oriented with an angular offset with respect to a main orientation of the main portion. In other words, the neck portion may be inclined with respect to the main portion of the housing.

In one embodiment of the hair cutting appliance, the main portion houses a driving shaft, wherein the neck portion houses an output shaft, wherein the driving shaft and the output shaft are arranged at an overall offset angle $\delta$, wherein the transmission shaft of the coupling linkage couples the driving shaft and the output shaft, wherein the transmission shaft is arranged at a partial offset angle $\alpha$ with respect to the output shaft, wherein the partial offset angle $\alpha$ comprises an angular dimension being substantially half the size of an angular dimension of the overall offset angle $\delta$.

BRIEF DESCRIPTION OF THE DRAWINGS

These and other aspects of the invention will be apparent from and elucidated with reference to the embodiments described hereinafter. In the following drawings

DETAILED DESCRIPTION OF THE INVENTION

Figure 1:
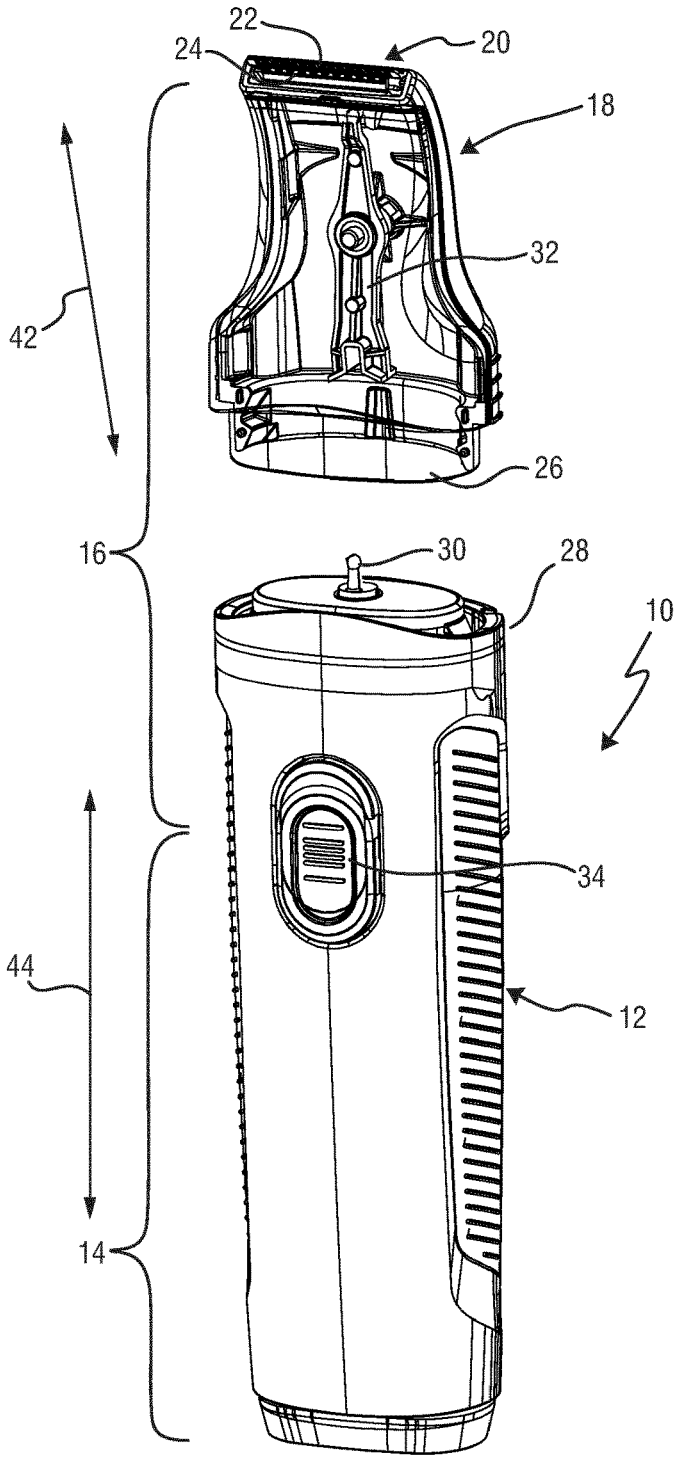
FIG. 1 shows a schematic perspective view of an exemplary electric hair cutting appliance comprising a cutting head which is shown in a detached state.

FIG. 1 shows schematically illustrates a hair cutting appliance 10, particularly an electric hair cutting appliance 10. The hair cutting appliance 10 may include a housing 12 which may house a motor for driving the hair cutting appliance 10. The housing 12 may further house a battery, such as, for instance, a rechargeable battery, a replaceable battery, etc. However, in some embodiments, the hair cutting appliance 10 may be provided with a power cable for connecting a power supply. A power supply connector may be provided in addition or in the alternative to an (internal) electric battery. The housing 12 may further comprise an operating switch 34.

The housing 12 of the hair cutting appliance 10 may generally comprise a main portion 14 and a neck portion 16.

As shown in FIG. 1 in a detached state, the neck portion 16 may be associated with a cutting head 18 and, at least in some embodiments, with a receiving portion 28 for the cutting head 18 at the housing 12.

The cutting head 18 may comprise a blade set 20. The blade set 20 may comprise a stationary blade 22 and a movable blade 24. The stationary blade 22 and the movable blade 24 may be operated so as to generate relative motion therebetween. By way of example, the movable blade 24 may be reciprocatingly driven with respect to the stationary blade 22. Consequently, the stationary blade 22 and the movable plate 24 may cooperate to cut hair. An exemplary embodiment of a cutting head 18 including a particular embodiment of a blade set 20 will be further illustrated and described in FIGS. 10 and 11 hereinafter.

As shown in FIG. 1, it may be preferred that the cutting head 18 is releasable or detachable from the housing 12 of the hair cutting appliance 10. In other words, the cutting head 18 may be releasably attached to the housing 12. Consequently, respective interfaces have to be provided at the cutting head 18 and the housing 12. By way of example, the cutting head 18 may comprise a mounting portion 26 which is configured to engage the receiving portion 28 or to be received by the receiving portion 28 at the housing 12. Since basically a driving motor is provided at the housing 12 and may be therefore associated with the main portion 14, and since the drivable blade set 20 is provided at the cutting head 18 and therefore associated with the neck portion 16, also a respective drive train needs to comprise a respective interface. In other words, when a user attaches or detaches the cutting head 18 to the housing 12, also the drive train needs to be coupled and decoupled, respectively.

The blade set 20 illustrated in FIG. 1 is shown in a hidden edge mode wherein at least some hidden edges are visible, particularly for illustrative purposes. As can be further seen from FIG. 1, the housing 12 may comprise a protruding driving member 30 which is configured to engage and cooperate with a transmitting member 32 at the cutting head 18. By way of example, the driving member 30 may comprise a driving shaft including an eccentric coupling member which may rotate about an axis of the driving shaft. Consequently, the eccentric member may engage a respective drivable slot at the transmitting member 32 for reciprocatingly driving the transmitting member 32 and, consequently, the movable blade 24 of the blade set 20. For improving the cutting performance of the hair cutting appliance 10, it may be advisable to arrange the blade set 20 in a particular orientation with respect to a main orientation of the housing 12. This may involve arranging the blade set 20 at an angle with respect to the housing 12. Such an angled or inclined arrangement may enhance the visibility of the blade set when the hair cutting appliance 10 is used for cutting hair. Furthermore, manually grasping and handling the device which may involve moving the hair cutting appliance 10 through hair in a desired manner may be simplified when the blade set 20 is arranged to assume a predefined orientation with respect to the housing 12, particularly to a handling portion thereof.

As used herein, the main portion 14 and the neck portion 16 do not necessarily have to be strictly associated to respective components of the hair cutting appliance 10 as indicated in FIG. 1. There may be alternative embodiments of hair cutting appliances 10 that may be modified with respect to the position of the "interface" between the housing 12 and the cutting head 18. As exemplarily shown in FIG. 1, the main portion 14 may comprise at least a substantial portion of the housing 12. The neck portion 16 may involve the cutting head 18, particularly a housing thereof, and at least a small portion of the appliance's base housing 12.

It may be generally preferred that the neck portion 16 of the hair cutting appliance 10 is at least slightly curved or inclined with respect to a main orientation of the main portion 14. A main orientation of the main portion 14 is exemplified in FIG. 1 by an arrow indicated by reference numeral 44. An orientation of the neck portion 16 or, rather, the cutting head 18 is exemplified in FIG. 1 by an arrow indicated by reference numeral 42. Consequently, the main portion 14 and the neck portion 16 may be arranged at an angle of inclination with respect to each other, refer also the angle δ (delta) shown in FIG. 2.

Generally, a driving motor may be arranged in the housing having a main orientation that is basically parallel to the main orientation 44 of the housing. Consequently, also a motor shaft may be basically aligned with the main orientation 44. Hence, there might be the need to "bridge" an angular offset between the orientation of the main portion 14 and the orientation of the neck portion 16. Angular offset compensation may require complicated mechanisms which may increase the costs of the hair cutting appliance 10. Furthermore, there might be the adverse effect that a conventional angular offset compensating drive train causes vibration and noise which might interfere with the desired user sensation and cutting performance.

With reference to FIGS. 2 to 9, an exemplary embodiment of a drive train arrangement 50 for a hair cutting appliance will be illustrated and further described. The drive train arrangement or drive train 50 may be arranged to compensate considerable angular offsets between an input and an output member. The drive train 50 may generally be referred to as self-aligning drive train 50.

Figure 2:
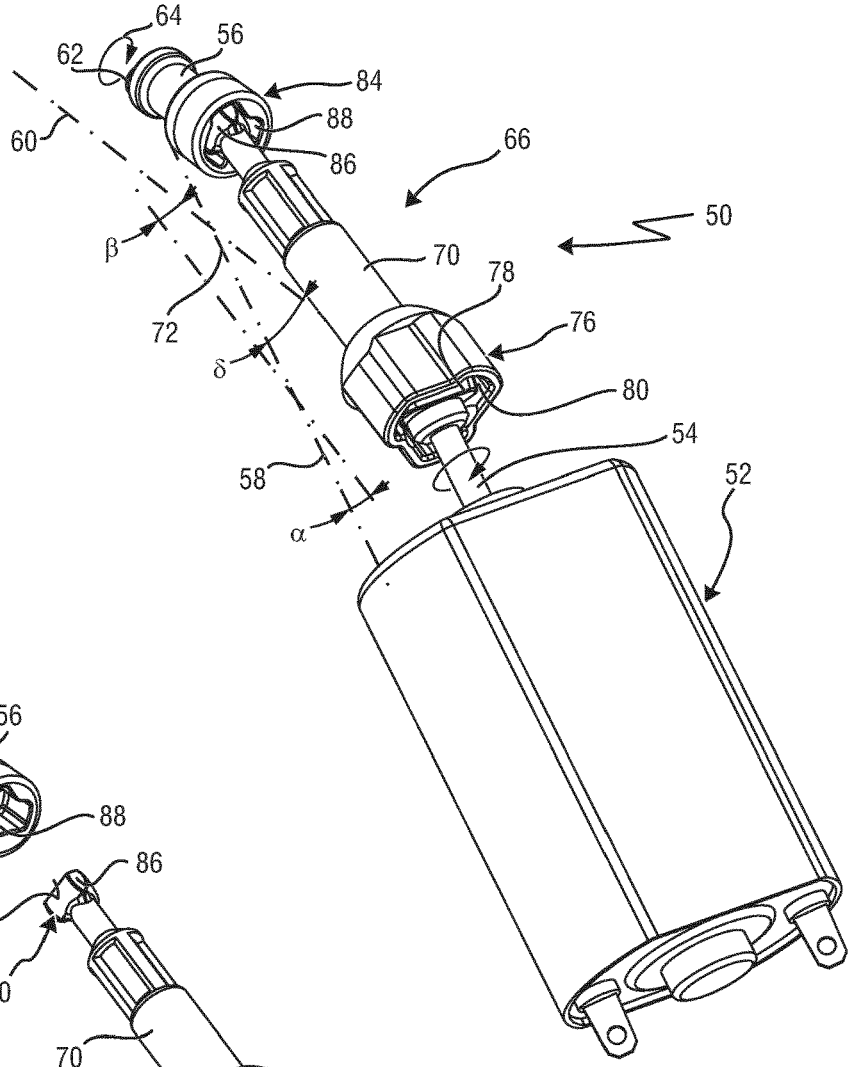
FIG. 2 is a perspective rear view of a drive train for a hair cutting appliance, the drive train comprising a coupling linkage mechanism.
Figure 3:
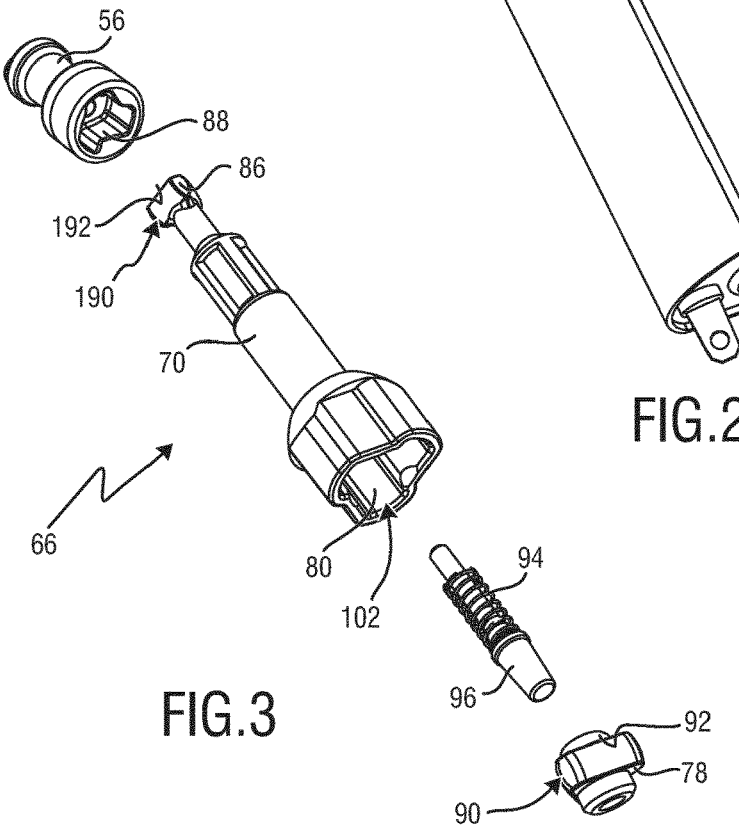
FIG. 3 shows an exploded perspective rear view of the coupling linkage mechanism in accordance with the embodiment illustrated in FIG. 2.

With particular reference to the perspective views of FIGS. 2 and 3, a general layout of the drive train 50 will be elucidated. The drive train 50 may comprise or be coupled to a motor 52, particularly an electric motor 52. The motor 52 may be arranged at a housing 12 of a hair cutting appliance 10 at an exemplary orientation which may be basically aligned with the main orientation 44. The motor 52 may comprise a driving shaft 54 which can be rotated by the motor 52. An orientation of the driving shaft 54 and, consequently, of the motor 52, is indicated by an axis 58 in FIG. 2. At an output end thereof, the drive train 50 may further comprise an output shaft 56. A main orientation of the output shaft 56 is indicated in FIG. 2 by an axis 60. The axis 58 and 60 may be arranged at an overall offset angle δ (delta). At an output end of the output shaft 56, an eccentric portion 62 may be provided. The eccentric portion 62 may be arranged to rotate about a central axis of the output shaft 56. Consequently, rotation of the output shaft 56, refer to the curved arrow indicated by 64 in FIG. 2, may be converted into a reciprocating motion which may be used to drive the movable blade 24 of the blade set 20.

Figure 10:
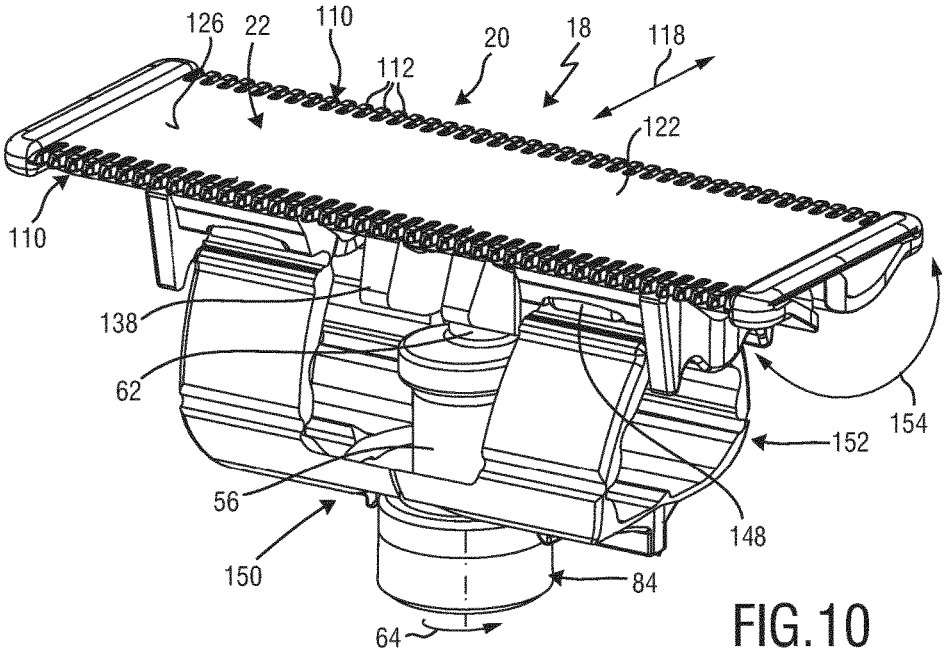
FIG. 10 is a perspective top view of a blade set for a hair cutting appliance, the blade set being attached to a contour following mechanism including a hinged pivoting mechanism, the blade set being arranged to be driven by a driving shaft.

It is worth mentioning in this context that it might be advantageous to attach the cutting head 18, particularly the blade set 20 thereof, in a pivotable manner at the housing 12 of the hair cutting appliance 10. This may have the advantage that the contour following capability of the hair cutting appliance 10 may be significantly increased. This may greatly improve the cutting performance, particularly the shaving performance of the hair cutting appliance 10. Reference in this regard is made to FIG. 10.

At least in some embodiments, pivotably arranging the blade set 20 may also require pivotably arranging the output shaft 56. Consequently, in these embodiments, the overall offset angle δ may be regarded as a variable angle. However, at least in some alternative embodiments, the angular orientation of the output shaft 56 with respect to the driving shat 54 may be substantially fixed. Consequently, a relatively constant angular offset may be present. It is particularly preferred that the drive train 50 is capable of "bridging" variable (unstable) overall offset angles δ. To this end, the drive train 50 may comprise a coupling linkage mechanism 66 which is capable of compensating angular offsets when transmitting rotations.

The coupling linkage mechanism 66 may further comprise a transmission shaft 70 which is interposed between the driving shaft 54 and the output shaft 56. A general orientation of the transmission shaft 70 may be illustrated by an axis indicated by reference numeral 72 in FIG. 2. The transmission shaft 70 may be coupled, at a first end thereof, to the driving shaft 54. The transmission shaft 70 may be further coupled, at a second end thereof, to the output shaft 56. Generally, the transmission shaft 70 may be configured to transmit torque or a rotational motion. Consequently, the transmission shaft 70 may be arranged to be driven by the driving shaft 54. Furthermore, the transmission shaft 70 may be arranged to drive the output shaft 56. The transmission shaft 70 may be arranged at an angle α with respect to the driving shaft 54. The transmission shaft 70 may be further arranged at an angle β with respect to the output shaft 56. The angles α and β may be regarded as partial offset angles. Needless to say, a sum of the angles α and β may basically correspond to the overall offset angle δ. Furthermore, each of the partial offset angles α and β could comprise half the size of the overall offset angle δ. It is worth mentioning in this context that the axes 58, 60 and 72 are shown in an offset state with respect to the respective shafts 24, 56 and 70 in FIG. 3, primarily for illustrative purposes.

The driving shaft 54 and the transmission shaft 70 may define a first pivoting joint 76. The first pivoting joint 76 may comprise a first driving coupling element 78 and a first drivable coupling element 80. The transmission shaft 70 and the output shaft 56 may define a second pivoting joint 84. The second pivoting joint 84 may comprise a second driving coupling element 86 and a second drivable coupling element 88.

As can be best seen in FIGS. 2 and 3, at least in some embodiments, the first driving coupling element 78 may be arranged as an engaging driving coupling element which may also be referred to as male driving coupling element. Consequently, the first drivable coupling element 80 may be arranged as a receiving drivable coupling element which may also be referred to as female drivable coupling element.

Furthermore, the second driving coupling element 86 may be arranged as an engaging driving coupling element which may also be referred to as male coupling element. The second drivable coupling element 88 may be arranged as receiving drivable coupling element which may also be referred to as female drivable coupling element. However, in the alternative, male and female coupling elements may be exchanged, at least in some embodiments.

Generally, the first driving coupling element 78 may be arranged at the driving shaft 54. The first driving coupling element 78 may be fixedly attached to or fixed at the driving shaft 54. The first drivable coupling element 80 may be arranged as the transmission shaft 70. The second driving element 86 may be arranged at the transmission shaft 70. The second drivable coupling element 88 may be arranged at the output shaft 56.

The first pivoting joint 76 and the second pivoting joint 84 may be basically arranged as rotary coupling joints. Consequently, the coupling linkage mechanism 66 may transfer rotational motion. It is particularly preferred that, with respect to the rotation transmission, at least one of the first pivoting joint 76 and the second pivoting joint 84 is arranged with low backlash or, more preferably, basically backlash-free. This may basically allow smooth running of the coupling linkage mechanism 66. Running noises, shocks, vibrations and jolts may be prevented or, at least, significantly reduced. This is advantageous since the driving shaft 54 and, consequently, the output shaft 56 may be rotated at high speed when the hair cutting appliance 10 is operated. The first pivoting joint 76 and the second pivoting joint 84 may be arranged to allow swiveling movement, particularly angular offset compensation movement between the respective coupled elements, particularly between the driving shaft 54 and the transmission shaft 70, at the first pivoting joint 76, and between the transmission shaft 70 and the output shaft 56, at the second pivoting joint 84.

Figure 7:
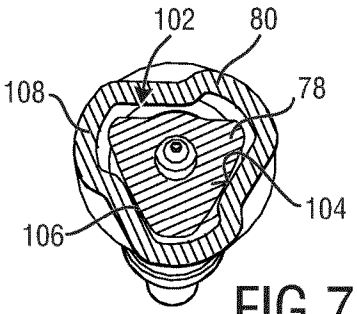
FIG. 7 is yet another cross-sectional view of the of the coupling linkage mechanism of the drive train shown in FIG. 4 taken along the line VII-VII in FIG. 4.
Figure 5:
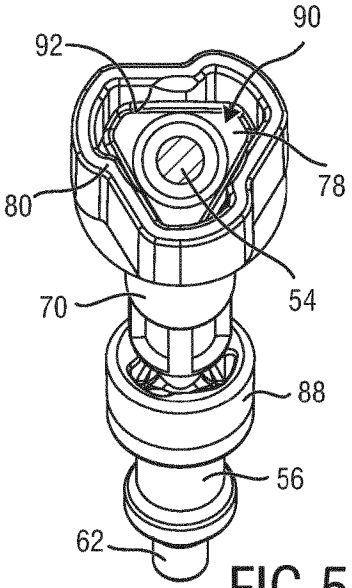
FIG. 5 is a cross-sectional view of the of a coupling linkage mechanism of the drive train shown in FIG. 4 taken along the line V-V in FIG. 4.
Figure 6:
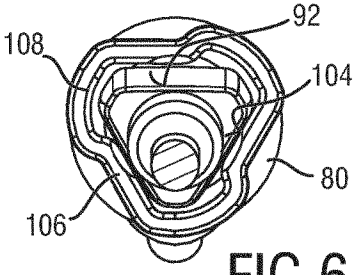
FIG. 6 is another cross-sectional view of the of the coupling linkage mechanism of the drive train shown in FIG. 4 taken along the line VI-VI in FIG. 4.
Figure 8:
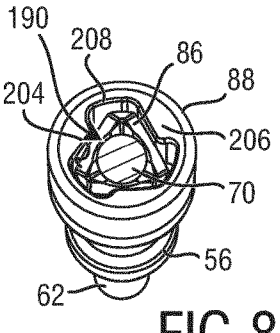
FIG. 8 is still another cross-sectional view of the of the coupling linkage mechanism of the drive train shown in FIG. 4 taken along the line VIII-VIII in FIG. 4.
Figure 9:
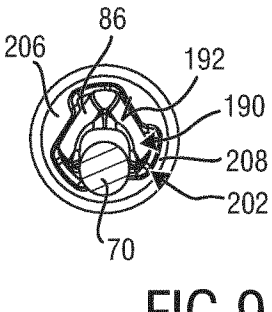
FIG. 9 is still yet another cross-sectional view of the of the coupling linkage mechanism of the drive train shown in FIG. 4 taken along the line IX-IX in FIG. 4.

With particular reference to the exploded view representation of the coupling linkage mechanism in FIG. 3, and with further reference to the sectional illustrations in FIGS. 4 to 9, an exemplary embodiment of the coupling linkage mechanism 66, particularly of the pivoting joints 76, 84 thereof, will be further illustrated and described. The cross-sectional view shown in FIG. 5 is basically perpendicular to a central axis of the driving shaft 54, refer to the line V-V in FIG. 4. The cross-sectional views shown in FIGS. 6, 7 and 8 are basically perpendicular to a central axis of the transmission shaft 70, refer to the respective lines VI-VI, VII-VII, and VIII-VIII in FIG. 4. The cross-sectional view shown in FIG. 9 is basically perpendicular to a central axis of the output shaft 56, refer to the line IX-IX in FIG. 4.

As can be best seen in FIGS. 3 and 5, the first driving coupling element 78 may comprise an external polygonal profile 90. Similarly, as can be best seen in FIGS. 3 and 8, the second driving coupling element 86 may comprise an external polygonal profile 190. The polygonal profiles 90, 190 may comprise respective driving flanks 92, 192. By way of example, the external polygonal profile 90 may comprise a basically triangular profile. It goes without saying that respective edges of the polygonal profile 90 may be rounded or chamfered. The flanks 92 of the external polygonal profile 90 may basically extend between respective edges of the polygonal profile 90. It goes without saying that, in some embodiments, the polygonal profile 90 may be provided with four, five or even further flanks 92. It is particularly preferred that the polygonal profile 90 is at least sectionally arranged as a spherical polygonal profile. It is particularly preferred that the driving flanks 92 are convexly shaped. As can be best seen in FIG. 4, the flanks 92 of the polygonal profile 90 may also comprise a convex axial extension. It is particularly preferred that the polygonal profile 90 is, at least at the flanks 92, spherically curved such that a defined contact with the first drivable coupling element 80 is achieved even when a considerable angular offset (refer to the angle α in FIG. 2) between the driving shaft 54 and the transmission shaft 70 is present. This may permit a smooth run of the first pivoting joint 76.

Figure 4:
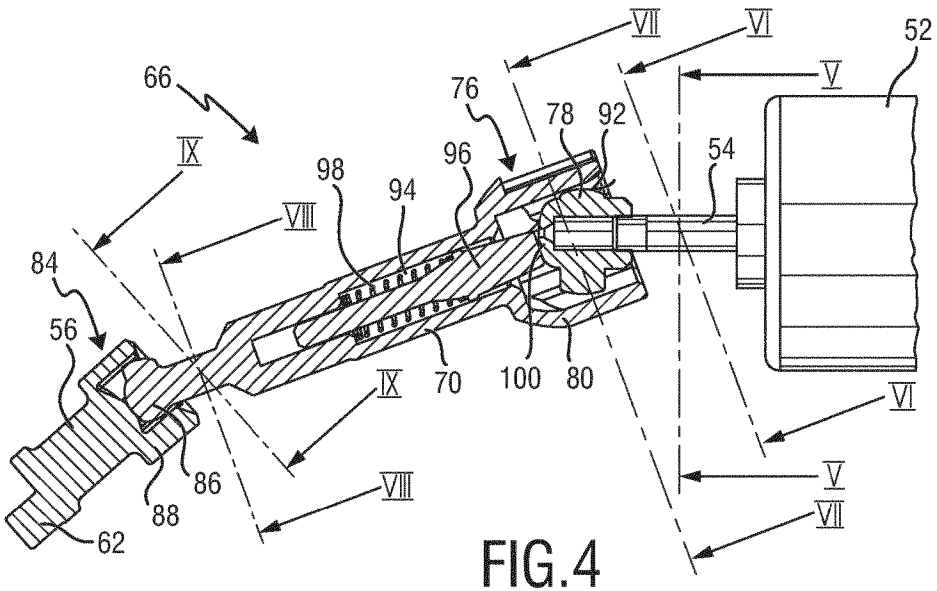
FIG. 4 is a cross-sectional side view of the drive train illustrated in FIG. 2.

As can be best seen in FIG. 3 and FIG. 4, the coupling linkage mechanism 66 may further comprise a push rod 96 which may be configured to apply a defined contact force to the driving shaft 54 and the transmission shaft 70, particularly a substantially axial contact force. By way of example, the push rod 96 may be coupled to a biasing element 94, particularly to a spring or, more explicitly, to a helical spring. The push rod 96 may be arranged at a recess 98 at the transmission shaft 70. In other words, the transmission 70 may house the push rod 96. Also the biasing element 94 may be arranged at the recess 98. The recess 98 may be arranged as an axially extending recess 98 at the transmission shaft 70. The biasing element 94 may be arranged in the recess 98 between the push rod 96 and the transmission shaft 70. Consequently, the biasing element 94 may urge the push rod 96 into contact with a contact front face 100 of the first driving coupling element 78. Furthermore, the biasing element 94 may urge the transmission shaft 70, particularly the second driving coupling element 86 thereof, into contact with the second drivable coupling element 88. Consequently, the drive train 50, particularly the coupling linkage mechanism 66 thereof, may be axially preloaded which may further contribute to the smooth-running capability of the drive train 50. As used herein, the term "axially preloaded" shall not be construed as requiring a perfect axial alignment of the respective shafts 54, 56 and 70. Generally, the biasing element 94 and the push rod 96 may compensate length deviations in the coupling linkage mechanism 66.

It goes without saying that, at least in some embodiments, the push rod 96 and the biasing element 94 also might be arranged at the driving shaft 54 or at the output shaft 56. Furthermore, the push rod 96 might also be arranged as an external push rod 94 externally mounted to the transmission shaft 70.

The external polygonal profile 90 of the first driving coupling element 78 may engage a corresponding internal polygonal profile 102 at the first drivable coupling element 80. In the same way, the external polygonal profile 190 at the second driving coupling element 86 may be arranged to engage a corresponding internal polygonal profile 202 at the second drivable coupling element 88. The internal polygonal profile 102 may be adapted to the external polygonal profile 90 for rotational entrainment. The internal polygonal profile 102 may comprise a plurality of drivable flanks 104 which may be adapted to the number of the driving flanks 92 of the external polygonal profile 90. However, as can be best seen in FIG. 7, the internal polygonal profile 102 may comprise further flanks which are not arranged as drivable flanks 104. Generally, the internal polygonal profile 102 may comprise (internal) protrusions 106 that alternate with (internal) indentations 108. The drivable flanks 104 may be arranged at the protrusions 106. As exemplarily shown in FIGS. 5, 6 and 7, the internal polygonal profile 102 may be arranged to receive the triangularly shaped external polygonal profile 90. However, in the alternative, the internal polygonal profile 102 may also be modified so as to receive a respective external polygonal profile 90 that comprises four, five or even more driving flanks 92. Also the internal polygonal profile 202 of the second drivable coupling element 88 may comprise respective drivable flanks 204. The internal polygonal profile 202 may be provided with (internal) protrusions 206 that are alternating with (internal) indentations 208, wherein the drivable flanks 204 are provided at the protrusions 206 to be contacted by respective driving flanks 192 of the external polygonal profile 190 of the second driving coupling element 86. Reference is made in this regard to FIG. 8 and to FIG. 9.

The second pivoting joint 84, particularly the external polygonal profile 190 and the internal polygonal profile 202 may be shaped and arranged much like the first pivoting joint 76, particularly the external polygonal profile 90 and the internal polygonal profile 102 thereof. This does not necessarily require that the first pivoting joint 76 and the second pivoting joint 84 need to have similar or equal oval dimensions. As can be seen from FIGS. 2 to 9, the first pivoting joint 76 and the second pivoting joint 84 may be different in size. However, it may be also envisaged to provide a respective coupling linkage mechanism 66 with two pivoting joints 76, 84 having basically the same size.

As a result of the at least partially spherical shape of the external polygonal profiles 90, 190, particularly due to the curved (or convexly curved) axial extension of the driving flanks 92, 192 thereof, the external polygonal profiles 90, 190 may basically swivel with respect to—or roll at—the drivable flanks 104, 204 of the internal polygonal profiles 102, 202 when the respective coupled shafts 54, 56, 70 alter their relative angular orientation. Consequently, the drive train 50 may be regarded as self-aligning drive train 50.

Figure 11:
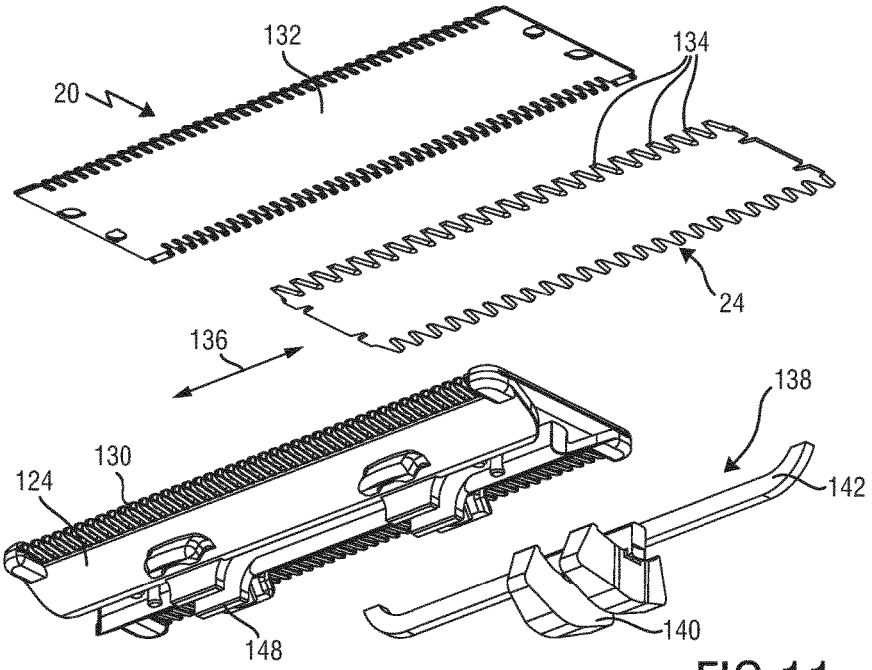
FIG. 11 is a perspective exploded bottom view of the blade set illustrated in FIG. 10.

With further reference to FIGS. 10 and 11, an exemplary beneficial embodiment of a blade set 20 for a cutting head 18 will be further illustrated and described. Advantageously, a drive train 50 in accordance with at least some aspects of the present disclosure may be operatively coupled to the blade set 20 for reciprocatingly driving a movable blade 24 thereof with respect to a stationary blade 22. FIG. 10 shows a perspective top view of an arrangement of a cutting head 18 wherein a blade set 20 is attached to a contour following mechanism 150. FIG. 11 shows a perspective exploded bottom view of the blade set 20.

The stationary blade 22 may comprise at least one toothed leading edge 110, particularly a first toothed leading edge 110 and a second toothed leading edge 110 opposite to the first toothed leading edge 110. At the at least one toothed edge 110, a plurality of teeth 112 may be provided. Between respective teeth of the plurality of teeth 112, tooth slots may be arranged through which hairs may enter the blade set 20 to be cut in a joint operation by the stationary blade 22 and the movable blade 24. The blade set 20 and a hair cutting appliance 10 fitted with the blade set 20 can be moved through hair in a moving direction 118 to cut hair. The blade set 20 is particularly configured to enable shaving and trimming operations. Shaving may be regarded as cutting hair very close to a user's skin level. Trimming may be regarded as cutting hair at a desired predefined length with respect to the skin level.

The stationary blade 22 of the blade set 20 may comprise a first wall portion 122 (refer to FIG. 10) and a second wall portion 124 (refer to FIG. 11). The first wall portion 122 and the second wall portion 124 may be at least partially offset from each other to define a guiding slot therebetween. In the guiding slot, the movable blade 24 may be slidably arranged. The first wall portion 122 may be regarded as a skin-facing wall portion. At the first wall portion 122, a top surface 126 may be provided. Particularly when a hair cutting appliance 10 fitted with the blade set 20 is used for shaving, the top surface 126 may contact the to-be-shaved skin.

The first wall portion 122 and the second wall portion 124 may be mutually connected at the at least one toothed leading edge 110 to define the plurality of teeth 112 at the at least one toothed leading edge 110. Consequently, the teeth 112 may comprise a basically U-shaped cross section, wherein a first leg is formed by the first wall portion 122 and a second leg is formed by the second wall portion 124. A connector portion between the first leg and the second leg of the U-shaped section may define tips of the teeth 112. Between the first and the second leg, respective teeth 134 of the movable blade 24 may be arranged. Consequently, the stationary blade 22 may guard or cover the teeth 134 of the movable blade 24. More particularly, the stationary blade 22 may cover the teeth 134 of the movable blade 24 at a skin-facing side (first wall portion 122) and at a side facing away from the skin (second wall portion 124).

In some embodiments, the stationary blade 22 may be formed as a metal-plastic composite stationary blade. Consequently, the stationary blade 22 may comprise a plastic component 130 and a metal component 132, refer to FIG. 11. The plastic component 130 and the metal component 132 may jointly define the shape of the stationary blade 22. In one embodiment, at least a substantial portion of the first wall portion 122 is formed by the metal component 132. Furthermore, at least a substantial portion of the second wall portion 124 may be formed by the plastic component 130. The plastic component 130 and the metal component 132 may be mutually connected at the at least one leading edge 110. However it is not required that the first wall portion 100 is exactly formed by the metal component 132 and that the second wall portion 124 is exactly formed by the plastic component 130. By contrast, the plastic component 130 may entirely form the second wall portion 124 and, furthermore, form at least a minor portion of the first wall portion 122.

It is particularly preferred that the metal component 132 is arranged as an insert, particularly a sheet metal insert. Consequently, the stationary blade 22 may be obtained from an insert-molding process. This may involve that the plastic component 130 is formed from an injection-moldable plastic material. Molding the plastic component 130 may involve bonding the plastic component 130 to the metal component 132. The movable blade 24 may be arranged in the guide slot defined by the first wall portion 122 and the second wall portion 124 of the stationary blade 22 in a reciprocatingly movable manner. Reference in this regard is made to the double-arrow denoted by reference numeral 136 in FIG. 11 indicating the reciprocating motion of the movable cutting blade 24. Generally, the orientation of the reciprocating motion 136 may be basically perpendicular to the assumed moving direction 118.

For driving the movable blade 24, a transmitting member 138 may be provided. The transmitting member 138 may comprise a reciprocating member 140 and a contact bridge 142. Generally, as shown in FIG. 10, the transmitting member 138 may be engaged by the eccentric portion 62, particularly by an eccentric driving pin 62, of an output shaft 56 in accordance with at least some aspects of the present disclosure. Rotation of the output shaft 56 (refer to the curved arrow 64 in FIG. 10) may be converted via the eccentric portion 62 and the transmitting member 138 into a reciprocating motion 136, particularly a rectilinear reciprocating motion, of the movable blade 24.

In some embodiments, the eccentric portion 62 may engage at the reciprocating member 140 which may define a guide slot for the eccentric portion 62. The transmitting member 138 may be further provided with the contact bridge 142 which may be arranged between the reciprocating member 140 and the movable blade 24. More particularly, the contact bridge 142 may be configured to contact the movable blade 24 for driving the movable blade 24. By way of example, the contact bridge 142 may be bonded to the movable blade 24, particularly laser-bonded.

As can be best seen in FIG. 10, the blade set 20 may be attached to a contour following mechanism 150. To this end, a connector portion 148 may be provided at the stationary blade 22, particularly at the second wall portion 124 thereof, refer also to FIG. 11. The connector portion 148 may comprise at least one snap-on element. The blade set 20 can be detachably attached to the contour following mechanism 150. The contour following mechanism 150 may comprise at least one hinged pivot mechanism 152. The at least one hinged pivot mechanism 152 may be arranged at a four bar linkage mechanism. The hinged pivot mechanism 152 may provide the blade set 20 with an improved contour following capability. In other words, the blade set 20 may swivel or pivot with respect to a base of the contour following mechanism 150. A pivoting motion is illustrated in FIG. 10 by a curved double arrow indicated by reference numeral 154. Being provided with the capability to swivel or pivot, the blade set 20 may adapt its actual orientation to the skin shape which may further improve the cutting performance, particularly the shaving performance, of the hair cutting appliance 10.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A self-aligning coupling linkage of a drive train of a hair cutting appliance comprising a driving shaft and a non-aligning output shaft, said coupling linkage comprising:

a first driving coupling element to be driven by a driving shaft, a transmission shaft, comprising a first drivable coupling element at a first end and a second driving coupling element at a second end thereof, wherein said first driving coupling element engages the first drivable coupling element for rotatingly driving the transmission shaft, thereby forming a first pivoting joint, wherein the second driving coupling element is arranged to engage a second drivable coupling element of an output shaft, wherein the first driving coupling element and the first drivable coupling element define a first male connector comprising an external polygonal profile, viewed in a cross-sectional plane perpendicular to a longitudinal axis of the drive shaft, and a first female connector comprising an internal polygonal profile, and wherein the external polygonal profile of the first male connector, is sectionally provided with convexly shaped driving flanks, wherein the first driving coupling element and the first driveable coupling element are engaged such that a circumferential backlash is substantially minimized.

2. The self-aligning coupling linkage as claimed in claim 1, wherein the first drivable coupling element at the first end of the transmission shaft is arranged as an axially extending recess comprising an internal polygonal profile, and wherein the first driving coupling element is an external polygonal profile.

3. The self-aligning coupling linkage as claimed in claim 1, wherein the second driving coupling element and the second drivable coupling element form a second pivoting joint when engaged, wherein the second driving coupling element at the second end of the transmission shaft is arranged as a second male connector comprising an external polygonal profile, wherein the second drivable coupling element of the output shaft is a second female connector comprising an axially extending recess comprising an internal polygonal profile.

4. The self-aligning coupling linkage as claimed in claim 3, wherein the external polygonal profile of each of the first and second male connectors are at least sectionally provided with spherically shaped flanks.

5. The self-aligning coupling linkage as claimed in claim 3, wherein the internal polygonal profile of each of the first and second female connectors comprise a number of protrusions alternating with indentations disposed therebetween, wherein the protrusions and the indentations define a number of contact flanks arranged to contact the driving flanks of the polygonal profile of the respective male connector for rotational entrainment.

6. The self-aligning coupling linkage as claimed in claim 5, wherein the number of contact flanks of the female connector is adapted to a number of driving flanks of the respective male connector for rotational entrainment.

7. The self-aligning coupling linkage as claimed in claim 1, further comprising a biasing element, wherein the biasing element is interposed between the first drivable coupling element and the first driving coupling element.

8. The self-aligning coupling linkage as claimed in claim 7, wherein the biasing element is arranged in an axially extending recess at the transmission shaft, and wherein the biasing element urges the first drivable coupling element and the first driving coupling element substantially in an axial longitudinal direction of the transmission shaft.

9. The self-aligning coupling linkage as claimed in claim 7, wherein the biasing element is coupled to a push rod slidably arranged at the transmission shaft, and wherein the push rod is arranged to contact the first driving coupling element.

10. The self-aligning coupling linkage as claimed in claim 1, wherein the transmission shaft is rigid.

11. The self-aligning coupling linkage as claimed in claim 1, wherein the first driveable coupling element is a motor shaft.

12. The self-aligning coupling linkage as claimed in claim 1, wherein the biasing element is a spring.

* * * * *